United States Patent [19]

Pecker

[11] Patent Number: 5,031,909

[45] Date of Patent: Jul. 16, 1991

[54] ELECTRONIC ATHLETIC EQUIPMENT

[76] Inventor: Edwin A. Pecker, P.O. Box 24D18, Los Angeles, Calif. 90024

[21] Appl. No.: 520,079

[22] Filed: May 7, 1990

[51] Int. Cl.[5] ..... A63B 61/00

[52] U.S. Cl. ..... 273/29 A; 273/73 R; 273/73 D

[58] Field of Search ..... 273/29 R, 29 A, 73 R, 273/73 C, 73 D; 73/649, 570, 862.38, 862.43, 488, 493, DIG. 1, DIG. 4

[56] References Cited

U.S. PATENT DOCUMENTS

| | | | |
|---|---|---|---|
| 4,090,707 | 5/1978 | Saar | 273/29 A |
| 4,101,132 | 7/1978 | Conrey et al. | 273/29 A |
| 4,141,549 | 2/1979 | Hayes et al. | 273/29 A |
| 4,257,594 | 3/1981 | Conrey et al. | 273/29 A |
| 4,471,958 | 9/1984 | Piche | 273/29 A |
| 4,822,042 | 4/1989 | Landsman | 273/29 A |
| 4,870,868 | 10/1989 | Gastgeb et al. | 73/649 |

FOREIGN PATENT DOCUMENTS

| | | | |
|---|---|---|---|
| 2604970 | 8/1977 | Fed. Rep. of Germany | 273/29 A |
| 3436218 | 4/1985 | Fed. Rep. of Germany | 273/29 A |
| 0578075 | 10/1977 | U.S.S.R. | 273/29 A |
| 0689686 | 10/1979 | U.S.S.R. | 273/29 A |

*Primary Examiner*—Edward M. Coven
*Assistant Examiner*—Jessica J. Harrison
*Attorney, Agent, or Firm*—James Bartholomew

[57] ABSTRACT

Electronic athletic equipment is provided by installing one or more force sensors beneath selected strings loops which secure a string bed to a racquet, or the like. The string loops are selected to correspond with strings defining a target area within the string bed. When a movable game element impacts the target area, the force sensors are activated by pressure exerted thereupon by one or more stressed string loops. In response to activation of one or more force snesors, control circuitry affixed to the racquet triggers an audible signal generator, which in turn sounds an indicating signal that the target area has been struck. The present invention may be employed to produce different audible signals in response to different impact locations upon the string bed.

27 Claims, 1 Drawing Sheet

ELECTRONIC ATHLETIC EQUIPMENT

BACKGROUND OF THE INVENTION

The present invention relates to athletic equipment having a strung surface on which preferred areas for hitting a movable game element can be ascertained, for example, to impart optimal motion thereto or to minimize impact on one's wrist. More particularly, this invention relates to electronic athletic equipment which includes means for indicating when preferred areas of the strung surface have been contacted by the game element.

Generally speaking, sports played with a movable game element and athletic equipment having a strung surface, such as racquets for use in tennis, squash, badminton, etc. require considerable basic skills in order that one may play proficiently and without physical injury. The location at which the movable game element strikes the strung surface of the racquet plays an important role in determining the forces imparted to the game element and the hand, wrist or elbow of a player. For example, if a tennis racquet is swung such that a tennis ball strikes the racquet in approximately the center of the strung surface, then the tennis ball will leave the racquet with optimum velocity and the racquet will not tend to twist in the player's hand. Conversely, if the tennis ball strikes the racquet at a location spaced from the center of the strung surface, the racquet will usually twist the player's hand about the wrist or snap the hand back towards the elbow, so that the ball leaves the racquet at an undesired angle and less than optimum speed. Repeated forces twisting or snapping the hand, wrist and/or elbow resulting from improper contact between racquet and ball may eventually lead to physical injury to the player. Thus, the location on the strung athletic instrument at which contact is made with a movable game element greatly determines the resultant movement of the game element and the reactive forces transmitted to the player.

In order to improve playing ability and minimize the likelihood of injury, a number of devices have been invented to aid in training a player to consistently hit the game element in the center or "sweet spot" of the strung portion of athletic equipment. In general, such prior devices provide audible or visible signals which immediately alert a player ("feedback") when a game element has struck a predesignated portion of the athletic instrument. Unfortunately, such prior devices disadvantageously either require the use of a specially designed racquet and/or special strings, or change the playing characteristics of the racquet in a negative manner.

One such type of prior device comprises metal plates (which noisily clang together upon contact with a ball), a plastic diaphragm, or bead, or the like, which fits or clamps onto the string bed of a racquet for the purpose of signalling when a game element has contacted selected strings. This type of device, seen for example in U.S. Pat. Nos. 4,090,707; 4,141,549 and 4,471,958, actually attaches to one or more racquet strings, thereby interfering with the playing surface area of the racquet and undesirably changing the playing characteristics of the instrument.

Other types of disadvantageous prior devices for alerting a player to the contact of a game element upon predesignated strings require more complex apparatus and specially designed racquets, thereby hindering or eliminating the ability of such a device to be easily retrofit to an existing conventional racquet. Moreover, the manufacturing costs associated with complex devices and/or specially designed racquets is substantially higher. An example of one such prior device is found in U.S. Pat. No. 4,101,132 which utilizes opto-electric sensors built into a racquet frame. Yet another type of prior disadvantageous device for monitoring the impact location of a game element upon a strung surface requires the use of specially coated strings. The problems of providing an impact location monitoring device which is not attached to the playing area of the strings and which is not dependent upon special strings or racquet designs yet remains.

There exists, therefore, a significant need for an improved device that indicates the location at which a game element strikes a strung surface. Such a device is needed which is compatible with, and retrofittable to, a standard racquet using standard strings. Moreover, such a device is needed which does not change the playing characteristics of the racquet, which requires no placement of a load or object directly on the playing area of the strings, and which permits one to chose the size and location of a predetermined strung area that will trigger an indication whenever contacted by a game element. Further, such a device is needed which is lightweight (so that the playing characteristics of a racquet associated therewith remain the same), relatively inexpensive, and which provides an indication of the accuracy with which a player is striking the game element upon the predesignated areas of a strung athletic instrument. The present invention fulfills these needs and provides further related advantages.

SUMMARY OF THE INVENTION

The present invention resides in an impact sensing system which triggers an indication of an impact occurrence, and in strung athletic equipment combined with said impact sensing system in a manner achieving an electronic athletic instrument which provides an indication of the impact of a movable game element upon predesignated strung areas of said instrument. The present invention generally comprises force sensing means located beneath one or more string loops of a racquet, or the like, which correspond to said predesignated strung areas that one desires to monitor. Impact of a game element upon predesignated strung areas will create a tension upon those string loops which secure the strings of a designated area to a racquet frame. This tension upon selected string loops is detectable by the force sensing means beneath said string loops. Once impact has been detected, control circuit means responsive to the force sensing means will provide an indication, preferably audible, of the impact location within the strung area.

The present invention is advantageously compatible with standard racquets and can be most easily retrofit to existing racquets during restringing. Most desirably, the present invention enables strings to be monitored for impact without requiring any load or apparatus to be attached directly on the playing area of the racquet strings. This feature advantageously ensures that the present invention will not interfere with the player's swing or with contact between a game element and the racquet strings. This is in contrast to prior devices which interfere with the playing characteristics of a racquet associated therewith. The present invention is lightweight enough that it can be incorporated with a racquet without altering the weight of the racquet to a noticeable or significant degree.

The present invention advantageously permits a user to locate the desired target area which produces an audible signal (when a game element impacts thereupon) anywhere on the strung surface of a racquet. Moreover, the target area can be enlarged or reduced so that as a player's racquet skills change, the size of the target area (which delineates strung areas suitable for producing an optimum hit of the game element or a minimum of negative reactive forces upon the player's hand and arm) can be varied for use as a training aid that fine tunes the player's swing. Furthermore, in one preferred form of the invention, an audible indication of a player's accuracy is advantageously indicated by providing a first audible signal in response to an impact directly upon the target area and a second audible signal in response to an impact upon the fringe areas surrounding the target region, wherein the first and second signals differ in volume or tone. Finally, the present invention is beneficially durable, relatively inexpensive and is removable so that a racquet used in conjunction therewith can be returned to its original state (after training is completed, for example).

In one preferred form of the invention, force sensing means for detecting the impact of a game projectile upon one or more selected strings are located beneath selected string loops (i.e., between string of said loop and the underlying racquet frame) which secure strings of the target area to the racquet frame. Preferably, said force sensing means are located beneath the string loop of every string comprising the target area. The force sensing means may comprise one or more sensors that function as momentary switches, with mechanical switches or capacitive, resistive or piezoelectric sensors being employed as said momentary switches. The mechanical switch or switches include separated contacts that close when a game projectile impacts upon one or more strings within the target area. The resistive sensors preferably utilize conductive foam or conductive rubber, as used in telephone or computer keypads.

One preferred type of capacitance sensor which may be utilized as the force sensing means comprises a two-sided flexible piece of insulating material disposed beneath one or more string loops and having a first conductive member affixed to one side and a second conductive member affixed to the opposite side in an aligned relation with said first conductive member. The first and second conductive members are operatively associated with means for maintaining a potential difference therebetween. Whenever the insulating material is compressed by increased force upon a string loop (as a result of target strings contacting with a game element), the distance between the first and second conductive members changes, thereby producing a variation in capacitance which is sensed with control circuitry provided by the invention. The force sensing means can also comprise an insulating material having sensors and sensor leads printed thereon as printed circuitry, with said printed circuitry including transducer components. Alternatively, sensors and sensor leads can be mounted upon a flexible strip which is inserted beneath selected string loops.

A preferred type of piezoelectric sensor which may be utilized as the force sensing means comprises the design described in the preceding paragraph, except that the insulating layer is coated with piezeoelectric material. Whenever the strip is compressed between two conductive sensor areas the piezoelectric material generates a voltage change which is sensed by the control circuitry.

Many racquets having a frame member that provides a strung surface area also include a groove about the outside periphery of the frame member. Often this groove accommodates grommet means which fit between the string loops and the frame member, usually with racquet strings passing through apertures in the grommet means which align with apertures in the frame member. In this scenario, the force sensing means, preferably configured as a flexible strip, is located within the groove, either between the grommet means and the frame member or between the string loops and the grommet means. This groove may also accommodate sensor wires or leads that connect the force sensing means with control circuitry.

Alternatively, many racquets omit the grooved portion of the frame member while still including apertured grommet means between string loops and the frame member. In this scenario, the force sensing means is located between the string loops and the grommet means or between the grommet means and the frame member. Alternatively, the force sensing means may be integral with the grommet means.

The invention also includes control circuit means responsive to the force sensing means and attached to the frame member at a convenient location, preferably along a handle portion of the racquet. The control circuit means includes a power source, such as at least one battery, and means for providing an indication of the impact of a game projectile upon predetermined strings, when sensed by the force sensing means. The means for indicating preferably include an audio signal generating element, although visual signaling means, such as lights, are possible. The control circuit means includes tare adjustment means comprising a bridge circuit and summing circuit means for energizing the indicating means.

In one alternative form of the invention, the control circuit means may include transmitting means for providing an indicating signal to an earpiece receiver within the player's ear. In another preferred form of the invention, first force sensing means are provided for detecting the impact of a game element upon the target area of the string racquet surface while second force sensing means are provided for detecting the impact of a game element upon a fringe area immediately surrounding the target area, wherein the indicating means provides a first signal in response to the first force sensing means and provides a different second signal in response to the second force sensing means. Preferably, the first and second signals are audible sounds which differ in tone and/or volume.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
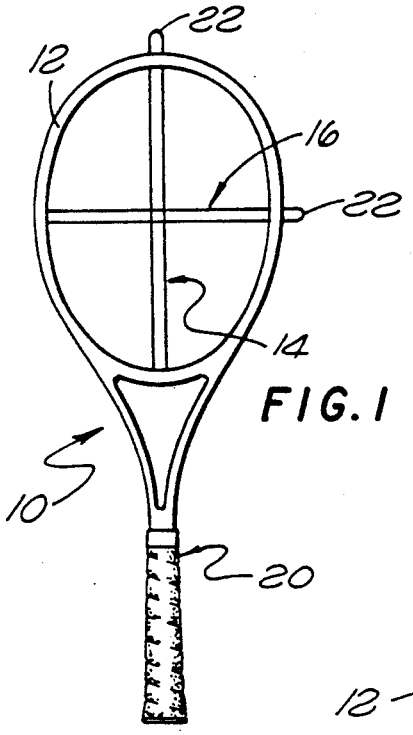
FIG. 1 is a front elevation view of an athletic racquet that can be adapted for use as electronic athletic equipment embodying the invention, showing string loops created during stringing of the racquet.

As shown in the drawings for purposes of illustration, the present invention resides in an athletic racquet having force sensing means which detect the impact of a game projectile upon predetermined target strings of the racquet. An embodiment of the present invention is illustrated with a tennis racquet 10, although it should be noted that the present invention is also applicable to any athletic equipment having a strung surface, for example, racquets used in playing badminton, squash, racquetball, etc.

The compatability of the present invention with various types of strung athletic equipment is just one of the many advantages associated therewith. The present invention does not place any load or apparatus directly on the playing area of the racquet strings so that no interference with the playing characteristics of the racquet is caused. In this vein the present invention is also lightweight so that the weight of the racquet is not adversely affected. The force sensing means and control circuit means of the present invention are compatible with any standard racquet using standard strings, thereby enabling practically any racquet to be converted to electronic athletic equipment by retrofitting the apparatus of the present invention thereto during stringing of the racquet. This is in contrast to many prior devices which were compatible only with a specially designed racquet and/or specially prepared strings. Advantageously, the present invention enables one to define a target area on the strung portion of the racquet which can be enlarged or reduced; moreover, the target area can be divided into a centermost area and fringe areas, each of which is audibly indicated in a different manner when a game projectile impacts thereupon.

Figure 2:
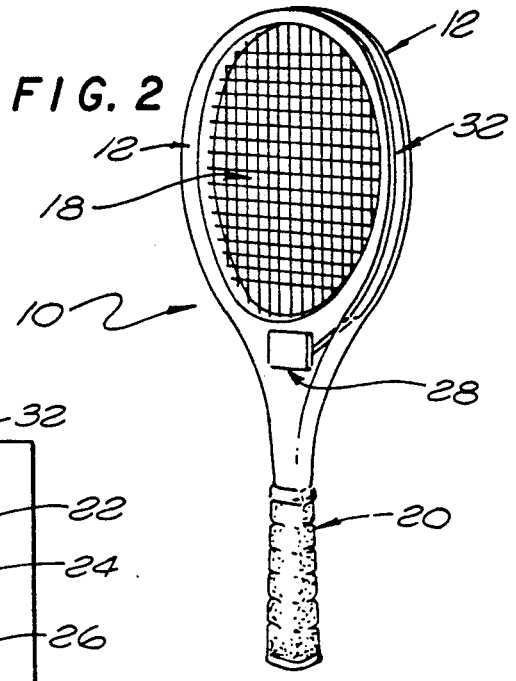
FIG. 2 is a perspective view of the athletic racquet of FIG. 1, showing a completely strung racquet having a sensor strip secured around the outer periphery of a frame member encompassing a string bed, and also showing a control circuit attached to both a handle portion of the racquet and the sensor strip.

A tennis racquet 10 suitable for use with the present invention is depicted in FIG. 1 as comprising a head portion having a generally oval shaped open frame 12 defining an included area and a plurality of longitudinal strings 14 and intersecting lateral strings 16 forming a netting matrix, or string bed 18 (FIG. 2), extending within said included area. The strings 14 ands 16 may be comprised of nylon, gut or similar string materials. A handle portion 20 extends axially from the frame 12. The frame and handle may be made from laminated wood, metal, epoxy-graphite composites and other materials commonly used in racquet construction, without departing from the scope of the present invention. For clarity's sake, FIG. 1 illustrates only a few strings 14 and 16 in order to clearly depict that in the conventional construction of racquets, strings are threaded through holes in the frame 12 in one direction, and then are looped back towards the frame and threaded into an adjacent hole therein which enables the threaded string to be returned across the frame in the opposite direction. This practice creates string loops 22 which connect pairs of adjacent strings in the string bed 18 (FIG. 2).

Figure 3:
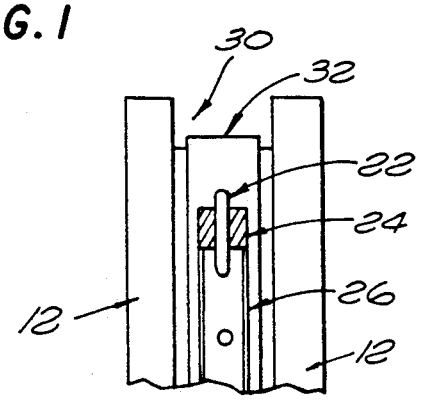
FIG. 3 is a fragmentary, enlarged side elevation view of an upper portion of the frame member of FIG. 2, illustrating a sensor disposed beneath a string loop and also showing sensor leads which connect the sensor or sensor strip to the control circuit of FIG. 2.

In accordance with the present invention, one or more force sensors 24 are placed under selected string loops 22, between the string comprising the loop and the frame 12, as depicted in FIG. 3. The selected string loops 22 correspond with selected strings 14 and 16 which comprise a selected target area on the string bed 18. Preferably, this target area should correspond with a so-called "sweet spot" that will impart optimal motion to a game projectile, such as a tennis ball, which strikes thereupon. Alternatively, the target area could be designated as that part of the string bed 18 which is most effectively used to contact a game projectile in a manner which will minimize or eliminate the transference of potentially injurious impact forces to a player's hand or arm. Generally speaking, the above referenced "sweet spot" lies along an axis extending through the center of the handle portion 20 and is located approximately one third of the distance between the handle and an outer end of the frame 12.

Once force sensors 24 have been installed beneath selected string loops 22 during stringing or restringing of the racquet 10, sensor leads 26 are used to electrically connect each force sensor 24 with a control circuit 28 (FIG. 2) affixed to a convenient location on the handle portion 20. When a game projectile strikes one or more strings having a force sensor 24 beneath their associated string loops 22, the tension in the impacted string or strings momentarily increases, as does the force exerted between the string loops 22 and the frame 12. This impact force activates the force sensor 24 which registers the impact with the control circuit 28 operatively associated therewith. In response to activation of one or more force sensors 24, an audible signal generator included within the control circuit 28 is sounded. Preferably, each selected string loop 22 (i.e. each target string to be monitored) has its own force sensor 24 associated therewith, each of which is independently connected to the control circuit 28 by sensor leads 26.

The sensors 24 are actually elements in an electrical circuit also comprising the sensor leads 26, the control circuit 28, and a power source 29 (FIG. 6), such as one or more batteries, incorporated within the control circuit 28. Preferably, the sensor leads 26 are accommodated within a groove 30 which is commonly provided around the periphery of the frame 12 of many racquets. The sensor leads 26 may be incorporated in a flexible sensor strip 32 (FIG. 2) which may be disposed within the groove 30.

Figure 4:
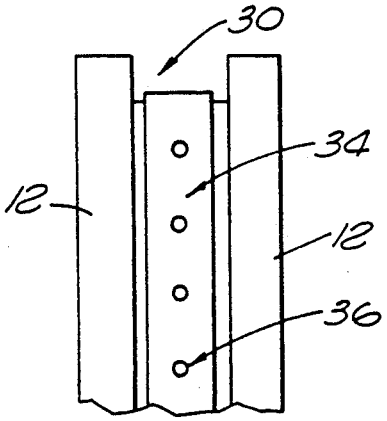
FIG. 4 is a fragmentary, enlarged side elevation view similar to FIG. 3 of an upper portion of a frame member of an athletic racquet having a groove about the periphery of said frame member, illustrating a grommet strip disposed within said groove and having string holes that align with string holes in said frame, wherein the sensor or sensor of FIGS. 2 and 3 is integral with said grommet strip or is disposed therebeneath (and thus is not visible)

Many conventional racquets include a strip of material known as a grommet 34 (FIG. 4) disposed between the string loops 22 and the frame 12. The grommet 34 acts principally to reduce wear between the strings and the frame. In racquets containing a groove 30 in the frame periphery, the grommet 34 is often accommodated within a groove 30. The grommet 34, which may be a continuous strip (as shown in FIG. 4) or a plurality of smaller individual grommets, includes apertures 36 which align with string holes within the frame 12. In order that the apertures 36 might be visible in FIG. 4, the string loops passing through said apertures 36 have been omitted. However, each of said strings 14 and 16 is anchored to the frame 12 by passage of each string through its respective hole in the frame 12, through an aligned aperture 36 in the grommet 34, then through a neighboring aperture 36 in the grommet which is adjacent to said aligned aperture, and finally through another neighboring hole in the frame which is adjacent to said respective hole and which aligns with said neighboring aperture in the grommet. This passage of each string length through appropriate aligned holes in the frame and apertures in the grommet is such that each string length loops about the frame 12, thereby creating a string loop 22.

The grommet 34 provides a preferred mode for incorporating the force sensors 24 and sensor leads 26 into a racquet 10 because said sensors and leads may be secured under the grommet 34, between the grommet 34 and the frame 12, or may be integrally incorporated within the grommet 34 itself. Alternatively, the sensor 24 and sensor leads 26 may be secured atop the grommet 34, between the grommet 34 and the string loops 22. To faciliate these placements, the flexible sensor strip 32 may be employed as means for accommodating the sensors 24 and/or the sensor leads 26. Although the sensors 24 or sensor leads 26 may be embedded into the frame 12 or laminated thereto, such practices are not preferred because they present a hindrance to easy retrofit installation of the invention onto existing racquets.

The control circuit 28 includes, in addition to the previously mentioned power source 29 and signal generator, a summing circuit or coincidence circuit 37 (FIG. 6) which energizes a buzzer 38 (FIG. 6), or similar audible signal generating means, when a desired set or sets of sensors 24 are activated by impact of a game projectile upon monitored strings. Other circuit components may include a "tare" or zero adjustment, to subtract out any initial forces applied when the racquet 10 is strung. This feature is also useful as the string tension of the racquet loosens with use. The control circuit elements enumerated herein are all of the micro-circuit variety.

The force sensor 24 may be any commercially available circuit component which changes its electrical characteristics when force is applied thereto. Suitable for use as the force sensors 24 are, for example, resistive components such as used in strain gauges, capacitive devices such as used in membrane switches, or momentary mechanical switches 40 (FIG. 6) having contacts sufficiently separated so as to close only when incremental force is exerted upon a monitored string (i.e. a string having a force sensor operatively associated therewith). A resistive element may also be provided by conductive rubber (such as used in keyboard assemblies) or by conductive foam (such as used in packaging electronic components). A preferred force sensor utilizes piezoelectric elements.

More specifically, among those recommended force sensors which could be used in the present invention are resistance foil strain sensors, as made by Micro Engineering II, Upland, Calif. and Revere Transducers, Cerritos, Calif.; piezoelectric transducers as made by ATOCHEM North America, Valley Forge, Pa. and Tekscan, Inc. of Boston, Mass.; and capacitive membrane switches as made by Grayhill, LaGrange, Ill.

Figure 5:
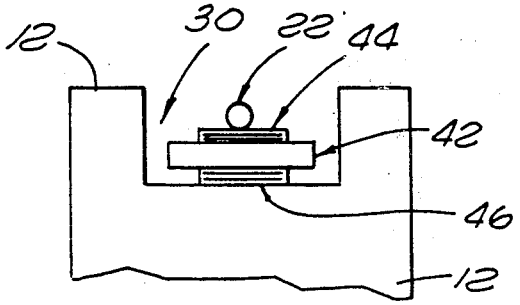
FIG. 5 is an enlarged, fragmentary cross sectional view showing a cut-away section of the grooved frame member illustrated in FIGS. 3 and 4, with the cut-away being taken generally along a plane which perpendicularly intersects the sensor strip disposed within the groove, showing a sensor strip comprising a center layer of insulation, preferably having a piezoelectric coating, and a top layer and a bottom layer of conductive material, all disposed between a string loop and the frame portion defining the groove, also depicting the alignment of the top and bottom conductive layers.

A preferred form of the force sensor 24 is illustrated in FIG. 5. This type of sensor comprises a middle layer of piezoelectric coated insulating material 42 having a top printed conductive element 44 and a bottom printed conductive element 46. The sensor is shown in FIG. 5 disposed between a string loop 22 and the frame 12. The top and bottom conductive elements 44 and 46, which may be, for example, three-sixteenths inch square, are in aligned relation as shown in FIG. 5. The conductive elements 44 and 46 are operatively associated with control circuit means. said means including the power source 29 and the sensor leads 26. When the sensor area 42 is compressed by the string loop 22 (as the result of impact upon the strings comprising loop 22), a voltage variation results which can be sensed by circuitry well known to those skilled in the electronic arts. Preferably, the sensor and sensor leads of this sensor strip are provided by printed circuitry printed on the insulating material 42, said printed circuitry including transducer components.

Figure 6:
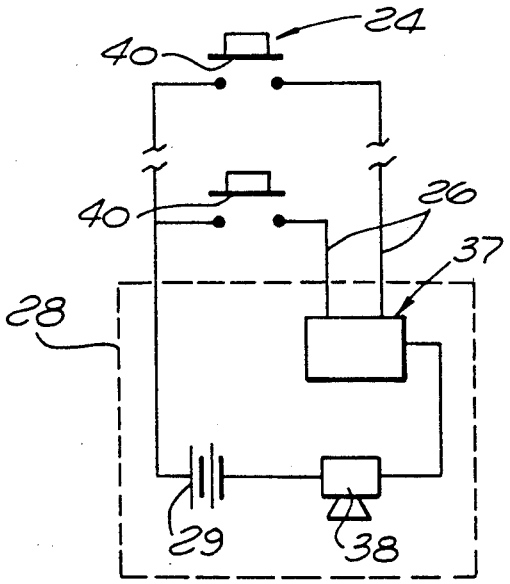
FIG. 6 is a schematic representation of two momentary switches which are closed by impact of a game projectile upon racquet strings that activate said momentary switches, also illustrating a battery powered buzzer for producing an audible indication of impact upon targeted strings.

The present invention advantageously allows one to choose the size of the target area by installing (or monitoring) force sensors 24 only under those string loops 22 which correspond to strings comprising the target area. Thus, the "sweet spot" or target area may be defined as a very small area, for example, by monitoring only one specific pair of longitudinal strings 14 and one particular pair of lateral strings 16. By selecting the coincidence of certain sets of string loop activation, the invention may be utilized such that the buzzer 38 is sounded only when both selected longitudinal strings and selected lateral strings are impacted. For example, FIG. 6 schematically shows a system wherein the buzzer 38 is energized only when both momentary switches 40 are closed. In the example of FIG. 6, one momentary switch 40 may be operatively associated with selected longitudinal strings while the other momentary switch 40 is operatively associated with selected lateral strings. Alternatively, the size of the target area which the present invention provides may be defined as any selected size and may be located anywhere within the string bed 18.

Yet another advantageous feature of the present invention is that impact upon the target area can be indicated in a different manner than impact upon fringe areas surrounding the target area. This provides the player with a better indication as to the exact portion of the string bed 18 which is contacting the game projectile. This is accomplished by providing first sensors for monitoring the strings of the target area and second sensors for monitoring the strings of the fringe areas. In response to the activation of the first sensors, the control circuit 28 provides for the generation of a first audible signal. In response to the activation of the second sensors, the control circuit provides for the generation of a second audible signal which differs from the first audible signal, preferably in tone and/or volume. Along these lines, all except a minimum target area can be subdivided into different zones producing different sounds when impacted by a game element.

Among the alternative forms which the present invention encompasses in an embodiment wherein the control circuit 28 includes transmitting means which send the audible indicating signal to an earpiece worn by the player or a nearby instructor. Also, the selection of monitored strings can be such that all strings which are not part of the target area are monitored so that impact upon the target area is indicated by silence, while impact upon any area outside the target area will cause an audible signal.

From the foregoing, it will be appreciated that the present invention allows an area within the string bed of a racquet to be targeted such that impact thereupon will produce an audible indicating signal. Further, the target area advantageously can be moved with respect to its position within a string bed and can be varied in size or shape. Moreover, the present invention beneficially allows different zones within the string bed to be indicated by different sounds. Finally, the present invention accomplishes the functions described herein in a lightweight, durable and relatively inexpensive fashion which advantageously does not interfere with the playing surface of athletic equipment or alter the playing characteristics thereof.

Inasmuch as the present invention is subject to many variations, modifications and changes in detail, it is intended that all matter described throughout this specification and shown in the accompanying drawings be interpreted as illustrative only and not in a limiting sense. Accordingly, it is intended that the invention be limited only by the spirit and scope of the appended claims.

I claim:

1. An athletic instrument suitable for propelling a game projectile, comprising:

a head portion having a frame member defining an included area and a plurality of longitudinal and intersecting lateral strings forming a netting matrix extending within said included area, said matrix including selected longitudinal and lateral strings which provide a preferred predetermined area for striking a game projectile to impart motion thereto, wherein said frame member includes a plurality of holes about its periphery and wherein each of said strings passes through adjacent holes in said frame member, thereby looping about said frame member to define a string loop, with said selected strings defining selected string loops;

a handle attached to said head portion;

force sensing means for detecting the impact of the game projectile upon one or more of said selected strings, said force sensing means being located beneath one or more selected string loops, between selected strings and the frame member; and control circuit means comprising a power source and means for providing an indication of the impact of a game projectile upon the preferred predetermined area, wherein said control circuit means is responsive to said force sensing means.

2. An athletic instrument as set forth in claim 1, wherein said means for providing an indication comprises a sound emitting element.

3. The combination as set forth in claim 1, wherein first force sensing means are provided for detecting the impact of a game element upon said preferred predetermined area, wherein second force sensing means are provided for detecting the impact of a game element upon portions of the included area which are immediately adjacent to said preferred predetermined area, wherein said indicating means provides a first signal when said control circuit means responds to the first force sensing means, wherein said indicating means provides a second signal when said control circuit means responds to said second force sensing means, and wherein said first signal is different than said second signal.

4. An athletic instrument as set forth in claim 1, wherein said power source comprises at least one battery.

5. An athletic instrument as set forth in claim 1, in combination with an earpiece receiver, wherein said control circuit means includes transmitting means for providing a signal to said earpiece receiver, said signal indicating the impact of a game projectile upon the preferred predetermined area.

6. An athletic instrument as set forth in claim 1, wherein a groove is provided in the periphery of the frame member and grommet means are disposed within said groove, said grommet means being located between each string loop and the frame member, wherein said grommet means includes apertures through which said strings pass, said apertures being aligned with the holes in the frame member, and wherein said force sensing means comprises one or more sensors mounted on a flexible strip which is located within said groove, between said grommet means and said frame member.

7. An athletic instrument as set forth in claim 1, wherein said force sensing means comprises one or more sensors mounted on a flexible strip.

8. An athletic instrument as set forth in claim 7, wherein said strip is comprised of an insulating material, and wherein said sensors comprise printed circuitry located on said strip.

9. An athletic instrument as set forth in claim 1, further including grommet means between each string loop and the frame member, wherein said grommet means includes apertures through which said strips pass, said apertures being aligned with the holes in the frame member and wherein said force sensing means comprises one or more sensors mounted on a flexible strip which is located between said grommet means and one or more string loops.

10. An athletic instrument as set forth in claim 1, further including grommet means between each string loop and the frame member, wherein said grommet means includes apertures through which said strings pass, said apertures being aligned with the holes in the frame member, and wherein said force sensing means comprises one or more sensors mounted on a flexible strip which is integral with said grommet means.

11. An athletic instrument as set forth in claim 1, wherein said force sensing means comprise a momentary switch having separated contacts which close when a game projectile impacts upon one or more of said selected strings.

12. An athletic instrument as set forth in claim 1, wherein said force sensing means comprises a piezoelectric sensor 13. An athletic instrument as set forth in claim 1, wherein said force sensing means comprises a capacitive sensor.

14. An athletic instrument as set forth in claim 1, wherein said force sensing means comprises a resistive sensor.

15. An athletic instrument as set forth in claim 14, wherein said resistive element is provided by conductive foam or conductive rubber.

16. In combination, a racquet suitable for use in propelling a movable game element, said racquet comprising a handle portion and a head portion, said head portion including a frame member having an inner margin defining an included area, said frame member supporting projectile propelling means within said included area for providing an impact zone to contact with the game element, the propelling means further including a plurality of longitudinal string lengths and a plurality of transverse string lengths cooperatively forming a striking matrix, said matrix including selected longitudinal and transverse strings which provide a preferred predetermined area for striking a game element to impart motion thereto, wherein said frame member includes a grooved portion about its periphery and a plurality of holes located within said grooved portion, wherein each of said string lengths is provided with respective holes for receiving opposite ends of said string length, said grooved portion accommodating a grommet strip having apertures which align with said holes, wherein each of said string lengths is anchored to said frame member by passage of said string length through its respective hole in said frame member, through an aligned aperture in said grommet strip, then through a neighboring aperture in said grommet strip, which is adjacent to said aligned aperture, and finally through a hole in said frame member which is adjacent to said respective hole and which aligns with said neighboring aperture, wherein said passage of each string length through appropriate aligned holes and apertures is such that each string length loops about said frame member, thereby defining a string loop, with said selected strings defining selected string loops;

force sensing means for detecting the impact of a game element upon one or more of said selected strings, said force sensing means being located beneath one or more selected string loops, between selected strings and the frame member; and control circuit means comprising a power source and means for providing an indication of the impact of a game element upon the preferred predetermined area, wherein said control circuit means is responsive to said force sensing means.

17. The combination set forth in claim 16, wherein said means for providing an indication comprises an audible signal generator.

18. The combination as set forth in claim 17, wherein said control circuit means is operatively connected to said force sensing means by sensor wires, wherein segments of said sensor wires are disposed within said grooved portion of said frame member.

19. The combination as set forth in claim 17, wherein said control circuit means further includes tare adjustment means comprising a bridge circuit.

20. The combination as set forth in claim 16, wherein said control circuit means further includes summing circuit means for energizing said indicating means.

21. The combination as set forth in claim 16, wherein each selected string loop has a force sensing means therebeneath.

22. A racquet comprising:

a frame which bounds a string surface defined by a plurality of string lengths, and a handle extending from said frame, wherein said frame includes a plurality of holes about its periphery, with a first set of adjacent holes being provided for one end of each of said string lengths and with a second set of adjacent holes being provided for an opposite end of each of said string lengths, wherein first and second sets of adjacent holes for a given string length are located at positions along the periphery of said frame which are opposite each other, wherein each string length passes through its respective first and second sets of holes in a manner forming string loops about said frame;

force sensing means for detecting the impact of a movable game element upon preselected areas of said string surface, said force sensing means comprising one or more capacitive sensors located beneath one or more selected string loops, each of said sensors comprising a bottom conductive member disposed immediately adjacent to said frame, a top conductive member disposed immediately beneath a designated string loop, and an insulating strip of material provided between said top and bottom conductive members, wherein said capacitive sensors are operatively contacted with circuitry means for sensing a variation in capacitance when said insulating strip is compressed between said top and bottom conductive members due to force exerted upon the designed string loop by a game element striking said preselected areas of said string surface; and control circuit means comprising a power source and means for providing an indication of the impact of a game element upon said preselected areas of said string surface, wherein said control circuit means includes said circuitry means for sensing capacitive variation.

23. A racquet as set forth in claim 22, wherein said means for providing an indication comprises an audible signal generator.

24. A racquet as set forth in claim 22, wherein one or more first capacitive sensors are provided for detecting the impact of a game element upon said preselected areas, wherein one or more second capacitive sensors are provided for detecting the impact of a game element upon portions of the string surface which are immediately adjacent to said preselected areas, wherein said audible signal generator provides a first signal when said first sensors detect the impact of a game element, wherein said audible signal generator provides a second signal when said second sensors detect the impact of a game element, and wherein said first signal sounds different than said second signal.

25. An athletic instrument suitable for propelling a game projectile, comprising:

a head portion having a frame member defining an included area and a plurality of longitudinal and intersecting transverse strings forming a netting matrix extending within said included area, said matrix including selected longitudinal and transverse strings which provide a preferred predetermined area for striking a game projectile to impart motion thereto, wherein a groove is provided in the periphery of said frame member;

a handle attached to said head portion;

force sensing means for detecting the impact of the game projectile upon one or more of said selected strings, said force sensing means being located within said groove; and control cicuit means comprising a power source and means for providing an indication of the impact of a game projectile upon the preferred predetermined area, wherein said control circuit means is responsive to said force sensing means.

26. An athletic instrument as set forth in claim 25 wherein grommet means are disposed within said groove, and wherein said force sensing means are located between said grommet means and said frame member.

27. An athletic instrument as set forth in claim 25 wherein said force sensing means comprises one or more sensors mounted on a flexible strip.

* * * * *